US005325014A

United States Patent [19]

Murai et al.

[11] Patent Number: 5,325,014

[45] Date of Patent: Jun. 28, 1994

[54] FLAT TUBE DISPLAY APPARATUS

[75] Inventors: Ryuichi Murai, Katano; Kinzo Nonomura, Ikoma; Jumpei Hashiguchi, Neyagawa; Satoshi Kitao, Kyoto, all of Japan

[73] Assignee: Matsushita Electric Industrial Co., Ltd., Osaka, Japan

[21] Appl. No.: 909,715

[22] Filed: Jul. 7, 1992

[30] Foreign Application Priority Data

Jul. 10, 1991 [JP] Japan ..... 3-169858

[51] Int. Cl.[5] ..... H01J 29/00; H01J 29/46

[52] U.S. Cl. ..... 313/422; 313/431; 313/433; 313/634

[58] Field of Search ..... 313/422, 432, 433, 409, 313/412, 413, 414, 431, 634

[56] References Cited

U.S. PATENT DOCUMENTS

| | | | |
|---|---|---|---|
| 3,253,175 | 5/1966 | Holle | 313/634 |
| 4,031,427 | 6/1977 | Stanley . | |
| 4,099,085 | 7/1978 | Endriz et al. . | |
| 4,166,233 | 8/1979 | Stanley . | |
| 4,167,690 | 9/1979 | Gange . | |
| 4,618,801 | 10/1986 | Kubino | 313/422 |
| 4,965,487 | 10/1990 | Freeman | 313/422 |

FOREIGN PATENT DOCUMENTS

| | | |
|---|---|---|
| 0281191 | 9/1988 | European Pat. Off. . |
| 0399515 | 11/1990 | European Pat. Off. . |
| 1299362 | 7/1969 | Fed. Rep. of Germany . |
| 63-228552 | 9/1988 | Japan . |
| 4-154028 | 5/1992 | Japan . |
| 835271 | 5/1960 | United Kingdom . |
| 1304893 | 1/1973 | United Kingdom . |

OTHER PUBLICATIONS

Katsumi Ura, "Electron Optics", issued by Kyoritsu Books Co., first pg., pp. 46–81 and last page, Dec. 1, 1979.

*Primary Examiner*—Donald J. Yusko
*Assistant Examiner*—Nimesh Patel
*Attorney, Agent, or Firm*—Stevens, Davis, Miller & Mosher

[57] ABSTRACT

Both side walls in a periodic magnetic lens device which are arranged in parallel with a planar fluorescent display surface and which define therebetween electron beam paths for guiding electron beams are formed in a shape which is concave-curved, and accordingly, the guide paths have a cross-sectional shape which is substantially rotationally symmetric in order to increase the possible travel distance of an electron beam.

8 Claims, 4 Drawing Sheets

O'
O'
N
S
N
S
N
S

FLAT TUBE DISPLAY APPARATUS

BACKGROUND OF THE INVENTION

The present invention relates to a flat-tube display apparatus in which electron beams run in parallel with a fluorescent screen surface before they impinge upon the latter, and in particular to a charged particle transmission apparatus used in the above-mentioned apparatus.

DESCRIPTION OF THE RELATED ART

Recently, the development of various kinds of flat type image display apparatuses has been very active. In particular, liquid crystal displays (LCDs), electroluminescent displays (EL), light emitting diode displays (LED) and the like are now commercially available, but they are inferior to color CRT tubes in terms of brightness, resolution, gradient, and full-colorization.

In order to eliminate the above-mentioned disadvantages, Japanese Patent Unexamined Publication No. 63-228552 discloses a CRT display apparatus. Further, in order to improve this CRT display apparatus, the inventors in the present application have proposed, in Japanese Patent Application No. 2-278339, a flat tube display apparatus. The present invention is devised in order to improve the flat tube display apparatus disclosed in the applicant's prior art, Japanese Patent Application No. 2-278339.

The prior art disclosed in the Japanese Patent Application No. 2-278339 will be explained with reference to the accompanying drawings in which like reference characters are used to denote like or corresponding parts throughout thereof. FIG. 3 shows the arrangement of the essential part of a flat tube display apparatus which is disclosed in the prior art, Japanese Patent Application No. 2-278339.

That is, there are provided, in a vacuum container 31, a face plate 37 coated on its vacuum side with a fluorescent material, an electron beam generating portion 34 including an electron beam source 32 and an electron beam lens system 33 for accelerating and converging electron beams from the electron beam source 32, an electron beam guide portion 35 for guiding electron beams emitted from the electron beam generating portion 34, to predetermined positions while preventing the electron beams from diverging, an electron beam deflection system for deflecting the thus guided electron beams toward the face plate 37, and an electron beam amplifying portion 36 for amplifying the deflected electron beams. In the above-mentioned arrangement, the face plate 37 is coupled to the electron beam amplifying system through the intermediary of pillars 38 having a high resistance. The high resistance pillars 38 are formed on the fluorescent material at parts where no light is luminescent, by printing etc., from frit glass, ruthenium oxide or the like. The resistance of these pillars is set to a value by which micro-current runs through the pillars in order to prevent occurrence of electric discharge between the face plate 37 and the electron beam amplifying portion 36.

The electron beam guide portion 35 will now be explained in detail. The electron beam guide portion 35 has a periodical lens which can be materialized by an electrostatic lens or a magnetic lens. It has been known that the electrostatic lens has a large aberration in comparison with the magnetic lens (Refer to, for example, "Electron Optics" issued by Kyoritsu Books Co. page 80). For example, U.S. Pat. No. 4,031,427 discloses the provision of the electro-static lens which is inferior in view of lowering of the electron beam transmission efficiency due to a large aberration and in view of the necessity of two kind of applied voltages. Accordingly, it is preferable to use a magnetic lens for efficiently transmitting electron beams, in view of manufacturing tolerance.

FIG. 4 shows a periodical magnetic lens in which N-poles and S-poles are alternately magnetized on the surface of each of support walls (which will be hereinbelow referred to "side walls") or therealong within the vacuum container, in the longitudinal direction (the direction in which electron beams run) thereof. That is, the periodical magnetic lens is composed of side walls having a width $l_1$ of 100 μm, a height $l_2$ of 120 μm, pitches $l_3$ of 200 μm and a length which depends upon the size of a flat tube type display apparatus and which is, for example, 290 mm in a 14-type flat tube display apparatus. Further, it is preferable to split each of the side walls into several parts in the longitudinal direction (which coincides with the electron beam running direction), as shown in FIG. 5, in order to enhance the intensity of the magnetic field on the center axis O-O'. The above-mentioned specific dimensions are determined by computer simulation in a three dimensional boundary process. The intensity of the magnetic field on the center axis O-O' is determined with the use of the length Pm−Ps of magnetic pieces and the pitches Ps of the magnetic pieces as parameters. Referring to FIG. 5 in which the length, the pitches, the widths and the height of the magnetic pieces are set respectively as Pm−Ps=300 μm, Ps=250 μm, W=100 μm, a maximum intensity of 100 gauss is obtained on the center axis O-O' of the electron beam guide portion 35. In this phase, it is estimated that the intensity of magnetization of the magnetic pieces is J=1,000 (Oe).

The following are specific methods of producing the periodical magnetic lens:

(a) A magnetic film made of a magnetic material such as Gd-Co, Gd-Fe or $\gamma$-$Fe_2O_3$ and having a thickness of 0.1 to 10 μm is formed on a glass substrate, and is then magnetized at pitches of 1 to 20 mm in the electron beam running direction. Similarly, a magnetic film is formed on a surface facing to the glass substrate, such as, a surface of a microchannel plate, and is then magnetized. Accordingly, electron beams are applied with positive and negative forces in a direction orthogonal to the electron beam running direction, and accordingly, they run while they diverge and converge repeatedly;

(b) Magnetic sheets such as ferrite sheets or the like are applied on beam isolating walls or a glass substrate, instead of the magnetic films mentioned in above item (a); and (c) A material in which at least magnetic powder is added to frit glass is selected for forming beam isolating walls. Then the material is printed by a screen printing process such as that used for a plasma display or the like, then is baked and magnetized. Thus, the beam isolating walls have a role of a lens.

The above-mentioned production methods (a) to (c) should satisfy the following conditions:

(a) the Curie temperature is higher than 450 deg.C; and (b) the coercive force is greater than 600 Oe.

The curie temperature is determined by a thermal process during manufacture of a flat-tube display apparatus. The coercive force is set to a value which does not affect the lens characteristic of a periodical magnetic lens, due to electric discharge during operation of the flat tube display apparatus.

The magnetic powder in which barium or strontium ferrite, frit glass and a viscosity adjusting agent are mixed together is printed.

In the case of forming a periodical lens having a configuration shown in FIG. 4 or 5, the method (c) mentioned above is most suitable in view of the intensity of the magnetic field and the mass production thereof.

The features of the above-mentioned flat tube display apparatus are such that a part of the pillars disposed in the inside of the vacuum container, for bearing the vacuum container against the atmospheric pressure can serve as a periodical magnetic lens in the electron beam guiding means, and that the electron beam source does not directly face the fluorescent display surface.

Prior art flat tube display apparatuses having a pillar structure are disclosed in U.S. Pat. Nos. 4,099,085, 4,166,233 and 4,167,690. However, these three flat tube display apparatuses have such an arrangement that electron beams emitted from an electron beam source are guided toward a fluorescent display surface in order to irradiate the same. That is, the ejection source and the fluorescent display surface are faced directly with each other. In this arrangement, when an electron beam irradiates on the fluorescent display surface, gas, ions or electrons are emitted from the fluorescent display surface. The emitted gas is ionized by electron beams running toward the fluorescent display surface. The thus produced ions are accelerated toward the low voltage side, that is, the ions bombard the electron source, causing the latter to deteriorate. As a result, the volume of electron beams emitted from the electron source decreases with the passage of time, and accordingly, the flat-tube display apparatus disadvantageously has a short useful life.

The operation of the flat tube display apparatus incorporating the electron beam guiding device which is arranged as mentioned above, will be explained hereinbelow. Electron beams emitted from the electron beam source 32 which are diverging are turned into collimated beams by the electronic lens system 33, and are then accelerated up to about 100 Oe by final electrodes. The electron beams from the electronic lens system are guided by the periodical magnetic lens in the electron beam guiding portion, and are subjected to electrostatic deflection at desired positions so that they are introduced into the electron beam amplifying portion 36 wherein the electron beams are multiplied by 10 to 20. The thus multiplied electron beams are accelerated by a potential difference between the final stage of the electron beam amplifying portion and the fluorescent display surface, which is about 8 kV so that they impinge upon the fluorescent display surface which therefore luminesces.

In the case of guiding the electron beams with the use of the periodical magnetic lens (rotationally asymmetric system), the volume I of an electron beam to be guided, is given by the following formula:

$$I=A\times b^2\times B^2\times(Vb-CB^2\times b^2)^{0.5}$$

where B is the intensity of a maximum magnetic field on the center axis O-O', b is the radius of the electron beam, Vb is the energy thereof, and A and C are constants.

Further, the electron beam volume has a maximum value which is given by the following formula:

$$I_{max}=16\times\pi\times\epsilon\times(e/m)^{0.5}\times Vb^{1.5}$$

From the experiment of beam transmission in such a prior art periodical magnetic lens, it was found that a current of about 1 μA could be transmitted by a distance of about 10 cm with a transmission efficiency of 70%, which is less than the value obtained by the theoretical expression, by an electron beam having an energy of 100 eV under a maximum magnetic field strength of about 250 gauss. However, substantially no current could be transmitted with the transmission distance set to 20 cm. This is because of the prior art periodical magnetic lens which is rotationally asymmetric. That is, there has been raised such a problem that the transmission efficiency of an electron beam remarkably decreases in a periodical magnetic lens which is rotationally asymmetric, if the transmission distance becomes long.

SUMMARY OF THE INVENTION

The present invention is devised in order to solve the above-mentioned problems inherent to the prior art, and accordingly, one object of the present invention is to provide a flat tube display apparatus which incorporates a periodical magnetic lens that can transmit a current of about 1 μA by a transmission distance of 300 mm.

To this end, according to the present invention, there is provided a flat tube display apparatus comprising an electron beam generating portion, a vacuum container having a fluorescent display surface, an electron beam amplifying portion arranged adjacent to the fluorescent display surface, a periodical magnetic lens means for guiding electron beams emitted from the electron beam generating portion, substantially in parallel with the fluorescent display surface, and a deflecting means for deflecting the electron beams guided by the periodical magnetic lens means, at predetermined positions so as to introduce the electron beams into the electron beam amplifying portion in which the electron beams are amplified before they impinge upon the fluorescent display surface for luminescence, wherein the above-mentioned periodical magnetic lens means comprises several side walls which are arranged substantially in parallel with each other, being spaced from each other, and which therefore define therebetween guide paths for guiding the electron beams, the guide paths having a cross-sectional shape which is substantially rotationally symmetric.

According to one specific form of the present invention, the above-mentioned side walls are preferably discrete in the longitudinal direction thereof, that is, they are composed of several magnetic pieces which are arrayed.

Further, according to another specific form of the present invention, the cross-sectional shape of the guide paths is preferably that of two temple bells vertically superposed with each other in a face-to-face relation.

According to another aspect of the present invention, there is provided an electron beam guiding apparatus comprising an electron beam source, a vacuum container, a converging means for converging electron beams emitted from the electron beam source, an electron beam control means for accelerating or decelerating the electron beams and a periodical magnetic lens means for guiding the running of the electric beams, the periodical magnetic lens means being composed of several side walls which are arranged substantially in parallel, being spaced from each other, so as to define therebetween guide paths for guiding the electron beams, having a cross-sectional shape which is substantially rotationally symmetric.

Since the electron beam guide paths having rotationally symmetric cross-sectional shape are formed in the periodical magnetic paths, the electron beams can run for a relatively long distance by a low energy. Further, the side walls defining the above-mentioned electron beam guide paths have a role of pillars with which the vacuum container can bear against an external pressure, thereby making it possible to provide a large size flat tube display apparatus.

Other objects, features and advantages of the invention will be apparent from the following description taken in connection with the accompanying drawing wherein:

BRIEF DESCRIPTION OF THE DRAWINGS

FIG. 5 is a schematic perspective view illustrating a periodical magnetic lens in a conventional electron beam guiding portion.

DETAILED DESCRIPTION OF THE INVENTION

Figure 1:
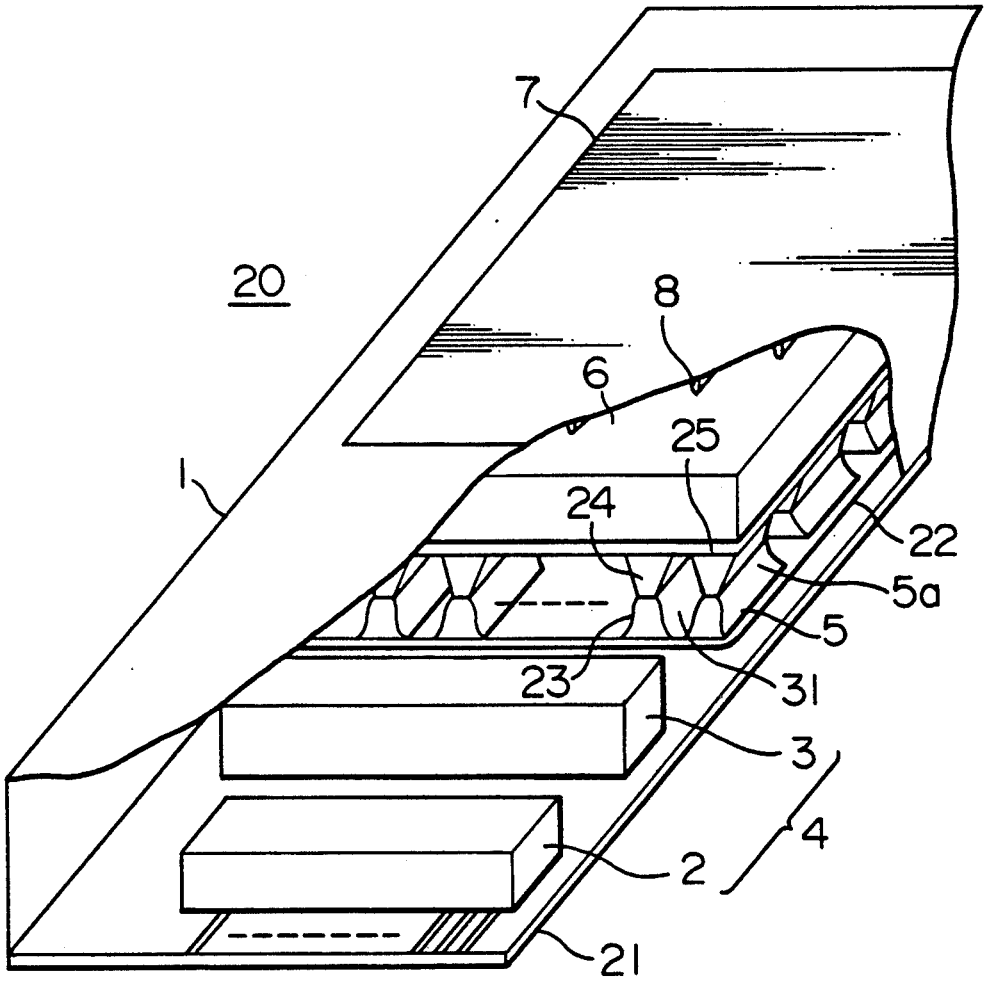
FIG. 1 is a perspective view illustrating a flat tube display apparatus in an embodiment form of the present invention.

FIG. 1 is a perspective view illustrating one embodiment of a flat tube display apparatus according to the present invention, which is denoted generally by reference numeral 20. In a vacuum container 1 having, on its upper surface, a face plate 7 serving as a planar display surface, an electron beam generating portion 4 including an electron beam source 2 utilizing thermal electron emission and an electronic lens system 3 for accelerating and converging electron beams emitted from the electron beam source 2 is provided on a bottom glass substrate 21. Further, a periodic magnetic lens device 5 for guiding the electron beams emitted from the electron beam generating portion 4, to respective desired positions while preventing them from diverging is laid on the glass substrate 21 through the intermediary of an electron beam deflecting system, that is, an electrode pattern 22. Further, an electron beam amplifying portion 6 is laid on the upper surface of the periodical magnetic lens device 5, and further, pillars 8 having a high resistance are provided on the upper surface of the electron beam generating device 5 so as to bear the face plate 7 against an external pressure. An electron beam which is guided along a beam path 31 in the periodical magnetic lens 5 is deflected at one of the electrodes in the electrode pattern 22 which is applied with a negative current, and is then led into the electron beam amplifying portion 6 in which the electron beam is amplified. The thus amplified electron beam impinges upon a fluorescent surface formed on the rear surface of the face plate 7 so that the fluorescent surface luminesces.

Figure 2:
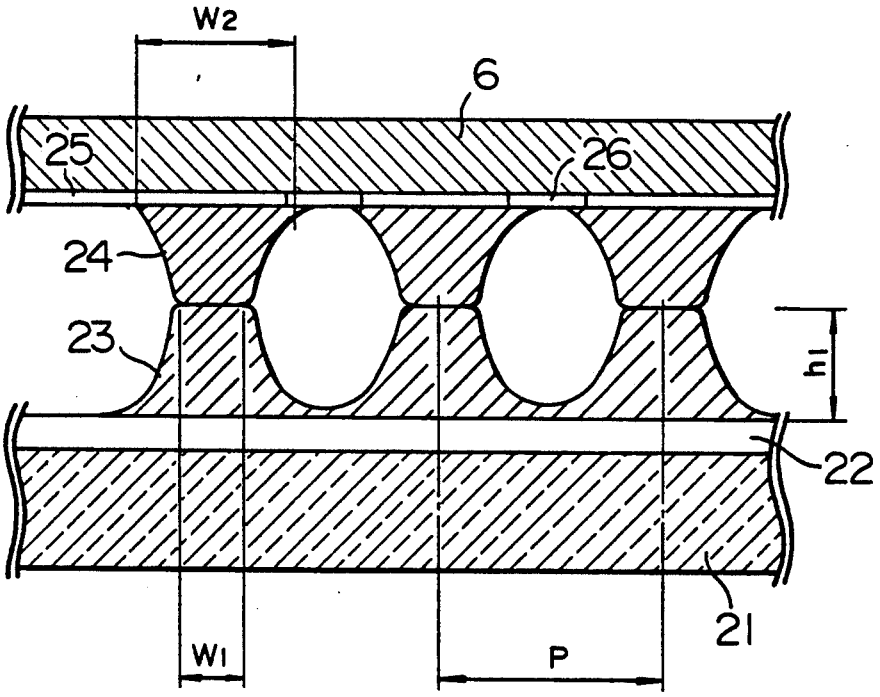
FIG. 2 is a cross-sectional view illustrating side walls used in an electron beam guiding portion in the flat tube display apparatus shown in FIG. 1.
Figure 3:
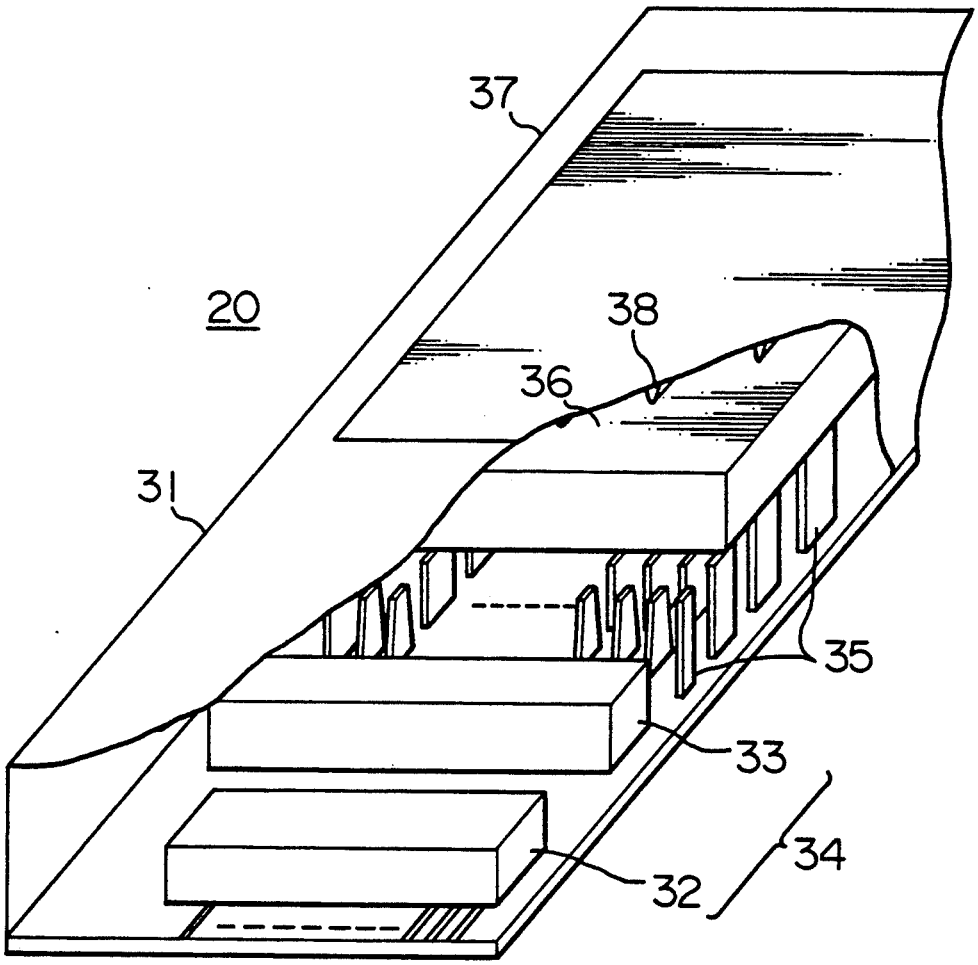
FIG. 3 PRIOR ART
FIG. 3 is a perspective view illustrating a conventional flat tube display apparatus.

Referring to FIG. 2, the above-mentioned periodical magnetic lens device 5 will be detailed.

Figure 4:
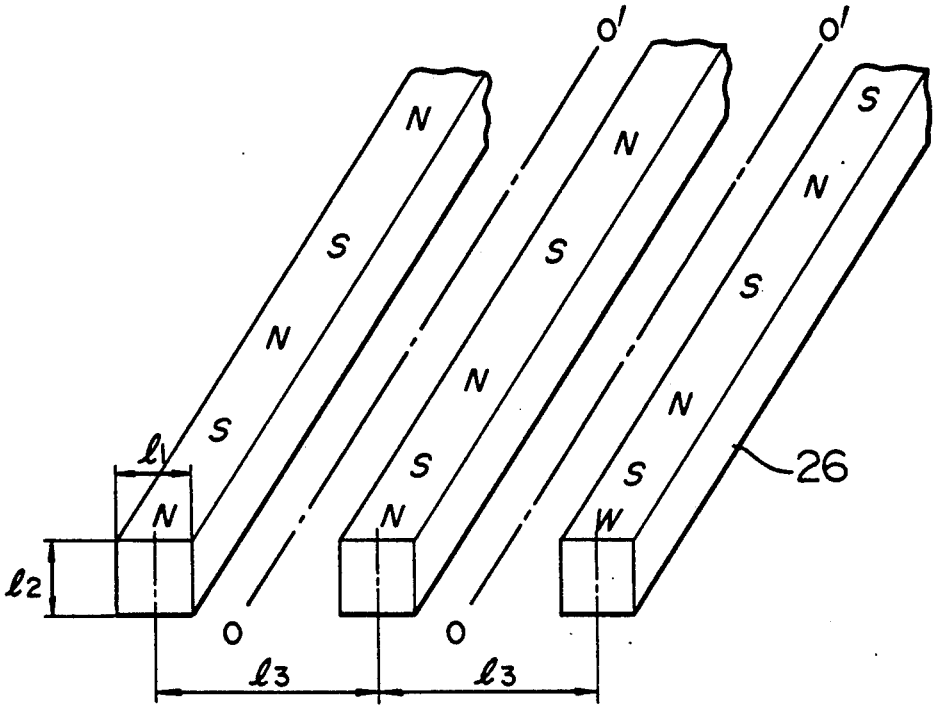
FIG. 4 PRIOR ART
FIG. 4 is a perspective view illustrating side walls used in a conventional flat tube display apparatus.

The periodical magnetic lens device 5 provided on the electrode pattern 22 is composed of several magnetic pieces 5*a* which are arranged so that they are laterally and longitudinally aligned with each other, that is, they constitute an array. The pattern of the array is similar to that of the conventional periodical magnetic lens shown in FIG. 4. However, the shape of the magnetic pieces is different from that of the latter. That is, both surfaces of the magnetic pieces 5*a* which define the beam paths 31 therebetween are formed in a concave curved shape so that the cross-sectional shape of the beam paths 31 is substantially rotationally symmetric or circular. As will be described hereinbelow, each of these magnetic pieces 5*a* is composed of upper and lower halves 24, 23 which are superposed with each other. Further, each adjacent upper halves 24 or lower halves 23 define therebetween a temple bell shape, and accordingly, the upper and lower halves 24, 23 together define therebetween the beam path 31 having the above-mentioned substantially rotationally symmetric cross-sectional shape, that is, a substantially circular cross-sectional shape.

Those of the magnetic pieces 5*a* which are arranged in the longitudinal direction can be integrally incorporated with each other so as to form indiscrete walls although the possible travel distance of an electron beam is decreased.

The above-mentioned periodical lens device 5 is formed by a screen printing process which will be explained hereinbelow.

The array of the lower halves 23 having a predetermined pattern is formed on the deflecting electrode pattern 22 which has been formed on the glass substrate 21 by screen printing. The lower halves 23 have an upper end width w of 30 to 40 μm, a height h of 80 to 100 μm and pitches p of 200 μm. The lower halves 23 have both surfaces which are formed into a concave curve shape so that the beam paths having the temple bell-like cross-sectional shape are formed therebetween. Thus, the array of the lower halves 23 can be simply and stably formed by using screen printing. The top parts of the lower halves are formed so as to have flat surfaces, and accordingly, the upper halves 24 can be easily superposed with the lower halves 23.

Similarly, the array of the upper halves 24 are printed on a metal plate 25 having a thickness of 0.4 mm. On the metal plate 25 there are many vacancies 26 through which the electron beams are led into the electron beam amplifying portion 6 and which should be prevented from being covered with printed matter.

After completion of the screen printing, the printed patterns are baked and then magnetized, and thereafter, the upper and lower halves 24, 23 are jointed together. Thus, the periodic magnetic lens device is formed.

From the experiment made by using the periodic magnetic lens of this embodiment, an electron beam of 2 μA was transmitted by a distance of 10 cm while an electron beam of 0.7 μA was transmitted by a distance of 20 cm under such a condition that the intensity of a magnetic field was 10 to 200 gauss and the energy of the electron beam was 100 eV.

As mentioned above, according to the above-mentioned embodiment, in which the beam paths defined by the magnetic pieces that are made of the mixture of low melting point glass and magnetic powder have a cross-sectional shape which is substantially rotationally symmetric, it is possible to enhance the transmission efficiency of electron beams having a micronic diameter.

It goes without saying that various kinds of magnetic materials other than barium or strontium ferrite, which are used in the above-mentioned embodiment, can be also used. Further, the periodic magnetic lens device of this embodiment can be effectively applied to other kinds of beam guiding devices such as progressive wave tubes or the like. Further, it can be applied in charged particle transmission devices of several kinds for guiding ions or the like, in addition to electrons, by setting the dimensions of the above mentioned components to suitable values.

As mentioned above, according to the present invention, the upper and lower halves of the magnetic pieces which have been separately formed by screen printing are joined together so as to produce a periodic magnetic lens of substantially rotationally symmetric cross-sectional shape, and accordingly, a micronic electron beam can be transported with a high degree of efficiency.

Accordingly, it is possible to easily produce a flat tube display apparatus which can have a large size with a simple structure, eliminating the problem of proof-voltage, and which can have a high degree of transmission efficiency.

What is claimed is:

1. In a flat tube display apparatus comprising an electron beam generating portion for emitting electron beams, a vacuum container having a planar fluorescent display surface, an electron beam amplifying portion arranged adjacent to the florescent display surface, a periodic magnetic lens device for guiding said electron beams emitted from the electron beam generating portion, substantially in parallel with said planar fluorescent display surface, and a deflecting means for deflecting the electron beams guided by said periodic magnetic lens device, at predetermined positions so as to introduce them into said electron beam amplifying portion whereby the electron beams introduced into said electron beam amplifying portion are amplified, and thereafter are caused to impinge upon said fluorescent display surface which therefore luminesces, the improvement wherein said periodic magnetic leans device comprises plural magnetic pieces having magnetic side wall portions arranged in plural substantially parallel rows and plural substantially parallel columns which are substantially perpendical to said plural rows, said plural rows defining therebetween guide paths for guiding electron beams, adjacent ones of said magnetic side wall portions of said plural columns defining through-channels which constitute part of said guide paths, and said adjacent magnetic side wall portions having shapes such that said through-channels have a cross-sectional shape that is substantially rotationally symmetric.

2. A flat tube display apparatus as set forth in claim 1, wherein the cross-sectional shape of said through-channels is that of two temple bells superposed with each other in a face-to-face relationship.

3. A flat tube display apparatus as set forth in claim 1, wherein said magnetic side wall portions are made of a glass material having a low melting point, which is composed of, at least, magnetic powder and PbO as main components.

4. A flat tube display apparatus as set forth in claim 3, wherein said magnetic powder is barium ferrite or strontium ferrite.

5. In an electron beam transmission apparatus comprising an electron beam source for emitting electron beams, a vacuum container, a converging means for converging said electron beams emitted from said electron beam source, a control means for accelerating or decelerating the electron beams, and a periodic magnetic lens device for guiding running of the electron beams, the improvement wherein said periodic magnetic lens device comprises plural magnetic pieces having magnetic side walls portions arranged in plural substantially parallel rows and plural substantially parallel columns which are substantially perpendical to said plural rows, said plural rows defining therebetween guide paths for guiding the electron beams, adjacent ones of said magnetic side wall portions of said plural columns defining through-channels which constitute part of said guide paths, and said adjacent magnetic side wall portions having shapes such that said through-channels have a cross-sectional shape that is substantially rotationally symmetric.

6. An electron beam transmission apparatus as set forth in claim 5, wherein the cross-sectional shape of said through-channels is that of two temple bells superposed with each other in a face-to-face relationship.

7. An electron beams source transmission apparatus as set forth in claim 5, wherein said magnetic side wall portions are made of a glass material having a low melting point and composed of, at least, magnetic powder and PbO as main components.

8. An electron beam transmission apparatus as set forth in claim 7, wherein said magnetic powder is barium ferrite or strontium ferrite.

* * * * *